US005596343A

United States Patent [19]

Snider

[11] Patent Number: 5,596,343

[45] Date of Patent: Jan. 21, 1997

[54] PUSHBUTTON CONTROLLER WITH BACKLIT DISPLAY AND SWITCH MEANS

[75] Inventor: Chris R. Snider, Kokomo, Ind.

[73] Assignee: Delco Electronics Corporation, Kokomo, Ind.

[21] Appl. No.: 303,797

[22] Filed: Sep. 12, 1994

[51] Int. Cl.[6] ..... G09G 3/36

[52] U.S. Cl. ..... 345/102; 345/87; 345/173

[58] Field of Search ..... 345/172, 102, 345/87, 173; 362/15, 294

[56] References Cited

U.S. PATENT DOCUMENTS

| | | | |
|---|---|---|---|
| 3,990,833 | 11/1976 | Holub et al. | 362/15 |
| 4,101,260 | 7/1978 | Wanninkhof et al. | 362/15 |
| 4,371,915 | 2/1983 | Broadt et al. | 362/15 |
| 4,410,795 | 10/1983 | Ueda | 345/172 |
| 4,487,481 | 12/1984 | Suzawa | 345/102 |
| 4,652,851 | 3/1987 | Lewin | 345/102 |
| 4,818,980 | 4/1989 | Strosser et al. | 345/102 |
| 5,063,379 | 11/1991 | Fabry et al. | 345/102 |
| 5,128,782 | 7/1992 | Wood | 345/102 |
| 5,143,433 | 9/1992 | Farrell | 345/102 |
| 5,235,636 | 8/1993 | Takagi et al. | 379/368 |
| 5,390,093 | 2/1995 | Himeno et al. | 362/294 |

*Primary Examiner*—Richard Hjerpe
*Assistant Examiner*—Juliana S. Kim
*Attorney, Agent, or Firm*—Jimmy L. Funke

[57] ABSTRACT

A backlit LCD is mounted in a controller having push buttons operating switch elements in a molded elastomeric switch pad for bridging pairs of switch terminals on a circuit board. The switch pad is white to reflect light and a portion of the switch pad behind the LCD is curved to serve as a reflector. A lamp between the display and the reflector illuminates the rear of the display directly and via reflection from the curved surface of the switch pad. This obviates the necessity of a separate reflector part in the controller assembly.

4 Claims, 2 Drawing Sheets

PUSHBUTTON CONTROLLER WITH BACKLIT DISPLAY AND SWITCH MEANS

FIELD OF THE INVENTION

This invention relates to push button controllers having back lighted displays and particularly to such apparatus having an integral molded switch pad and light reflector for the display.

BACKGROUND OF THE INVENTION

In automotive controllers with displays such as radio or heat and air conditioning controllers it is commonplace to employ manually operated push button switches for controlling various functions and a lighted display bearing information related to the control status. Commonly the switches comprise conductors on a printed circuit board and a conductive elastomeric switch pad with pushbutton features overlying the circuit board to selectively bridge adjacent conductors. Typically the switch pad is a molded gray silicone rubber material. Liquid crystal displays (LCDs) are often used for the displays and the illumination is provided by back lighting.

The back lighting is implemented by a lamp or lamps at the rear of the display unit and a reflector behind the lamps to increase the efficiency and the uniformity of the illumination. Usually a molded white plastic reflector is positioned at the rear of the display and is mounted on or adjacent the circuit board; in some cases the circuit board has an aperture at the display site and the reflector is behind the aperture and the display is in or in front of the aperture. In either case the switch pad has an aperture at the display site to accommodate the rear lighting scheme.

Since the switch pad and the reflector are juxtaposed in the controller assembly, it is desirable to combine them to reduce the number of parts in the assembly. Such reduction eliminates the tooling, manufacture, inventory and assembly of one of the parts, thereby reducing the cost of the assembly.

SUMMARY OF THE INVENTION

It is therefore an object of the invention to simplify a pushbutton controller and display assembly by combining two of the parts into a single molded unit.

A controller with an LCD display has a circuit board carrying conductors having adjacent terminal pairs which form switch contacts, and a molded elastomeric switch pad having a pushbutton element for closing the switch for each terminal pair. A conductive pellet in the push button element conductively bridges the contacts when depressed. A portion of the molded switch pad in the region behind the display is contoured to serve as a reflector and one or more lamps are located in front of the reflector surface. To effectively reflect the light from the lamps to the rear of the display, is the switch pad has a reflective surface or comprises reflective material; preferably the switch pad and reflector unit is molded of white elastomeric material.

A housing covering the front of the controller holds the display in place in front of the reflector and includes pushbuttons beside the display which are aligned with the pushbutton elements of the switch pad for effecting switch operation.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

While the ensuing description is directed to a controller having a backlit liquid crystal display (LCD), the invention is useful for other displays requiring back lighting and in other applications where pushbutton controls are used.

Figure 1:
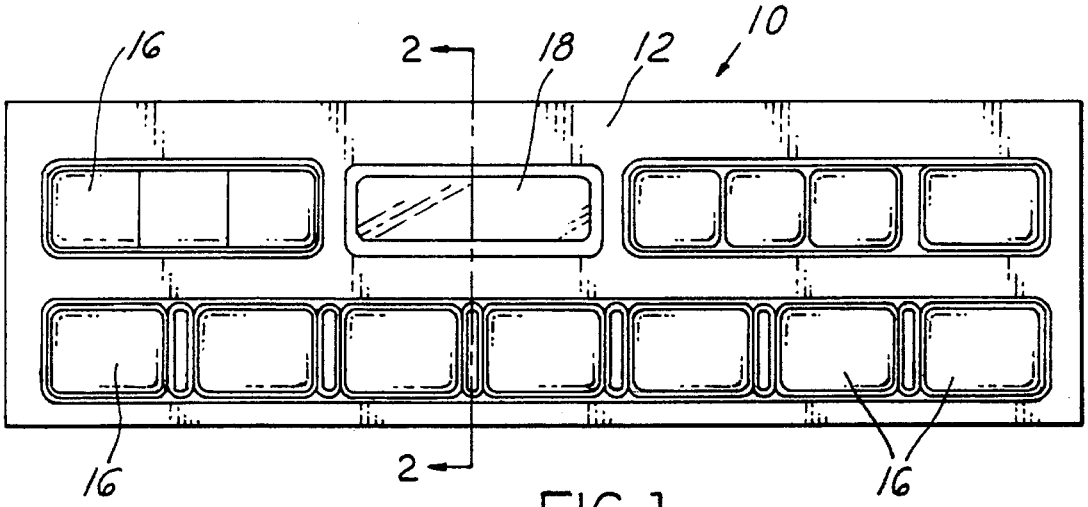
FIG. 1 is a front view of a controller having a backlit display incorporating a switch pad and reflector according to the invention.
Figure 2:
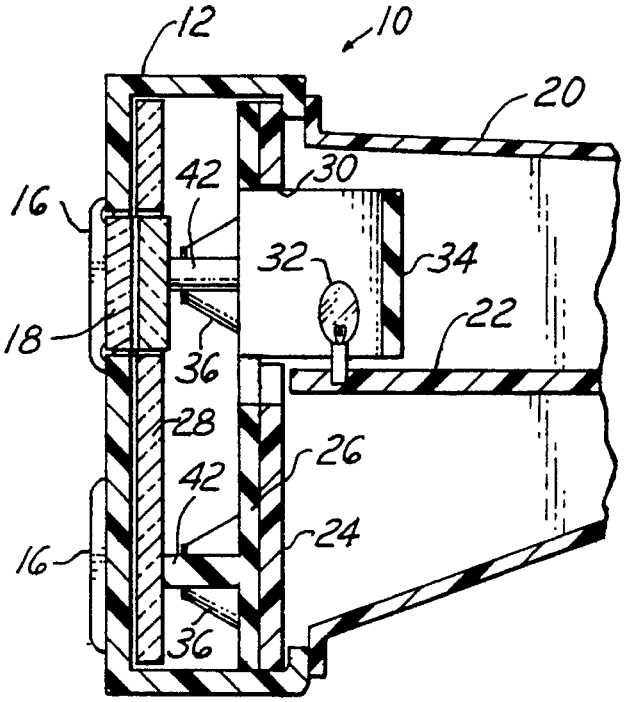
FIG. 2 is a cross-sectional view of the controller taken along line 2—2 of FIG. 1.

Referring to FIG. 1, a control panel 10 for an automotive heat, ventilation and air conditioning system has a housing 12 and an array of several switch push buttons 16 and an LCD 18. FIG. 2 shows that the housing 12 wraps around the top and bottom of the control panel 10 and that a case 20 extends back from the panel 10. The case 20 contains a horizontally disposed main circuit board 22 and electronic gear not shown.

The control panel 10 comprises a keyboard or printed circuit board 24 which is parallel to the front face of the control panel 10, a combined switch pad and reflector 26, a light conductive plate or light pipe 28 for illumination of the buttons 16, and the LCD 18. The light pipe 28 receives light from lamps, not shown, mounted on the circuit board 24. The circuit board 24 contains an aperture 30 directly behind the LCD 18, and a lamp 32 is supported by the main circuit board 22 just behind the aperture 30 so that the lamp 32 illuminates the rear side of the LCD 18.

Figure 3:
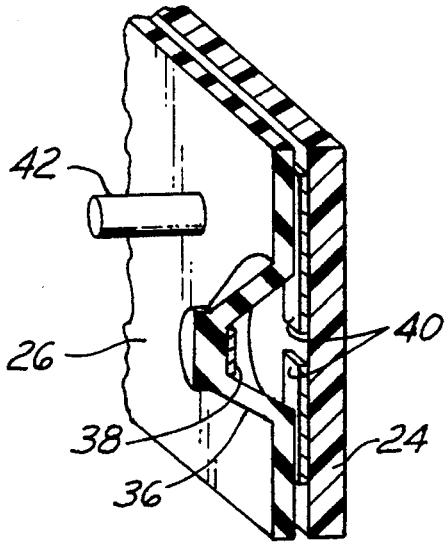
FIG. 3 is an isometric cross section of a portion of the switch pad and circuit board of the controller.
Figure 4:
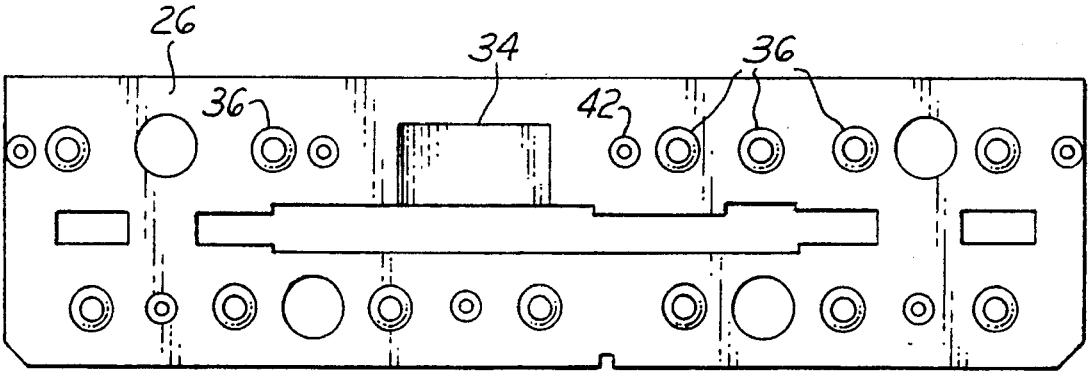
FIGS. 4 and 5 are front and top views, respectively, of a switch pad and reflector of the controller of FIG. 1, according to the invention.
Figure 5:
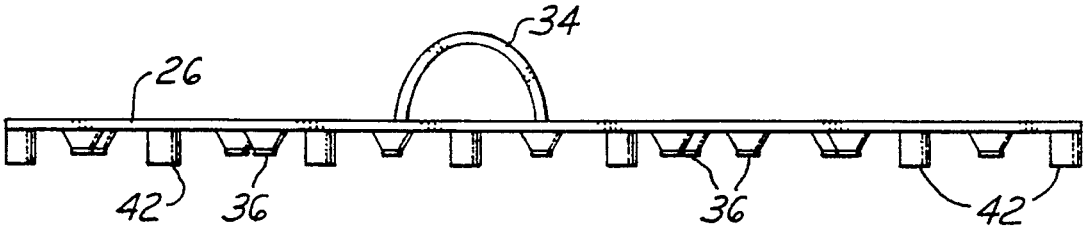

The combined switch pad and reflector 26, also shown in FIGS. 3, 4 and 5, is a white silicone rubber elastomer molding which overlies the circuit board 24. A rearwardly extending curved reflector 34 is part of the elastomer molding and protrudes through the aperture 30 in the circuit board 24. The reflector 34 curves around the lamp 32 so that the white front surface of the reflector 34 efficiently directs light from the lamp 32 to the LCD 18, so that the LCD 18 is illuminated both directly from the lamp and indirectly via the reflector 34. The switch pad 26 also carries well known frustoconical push button switch elements 36 each of which support a conductive carbon pellet 38 on its rear raised surface for bridging closely spaced terminal pads 40 on the circuit board 24, each pellet 38 and corresponding pair of pads 40 comprising a switch. Each such push button switch element 36 is aligned with and operated by a button 16 of the control panel 10 for closing the respective switch when a button 16 is depressed. Cylindrical standoffs 42 project forwardly from the switch pad 26 and bear against the rear surface of the light pipe 28 to assure a tight fit of the components within the control panel assembly. Apertures are provided for lamps, not shown, mounted in the circuit board 24 and which illuminate the light pipe 28.

Figure 6:
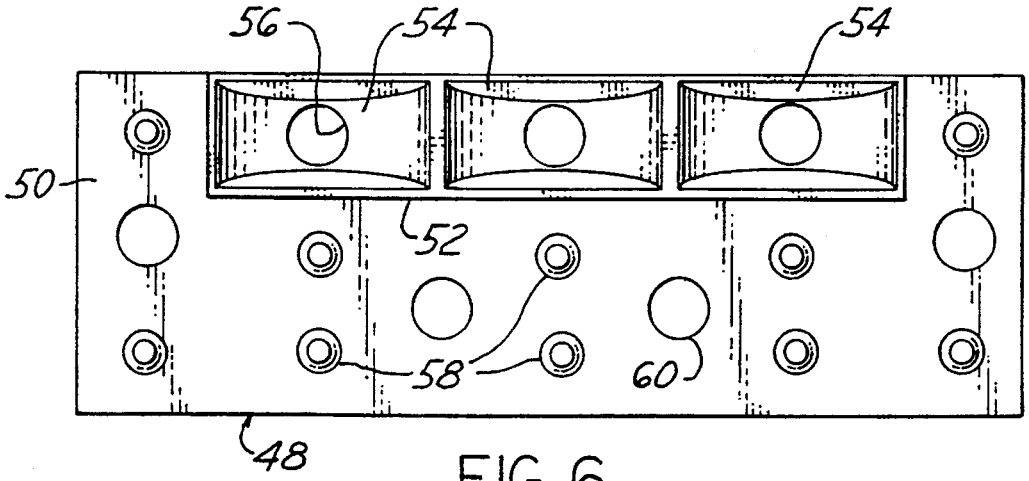
FIGS. 6 and 7 are front and top views, respectively, of a switch pad and reflector of a controller according to another embodiment of the invention.
Figure 7:
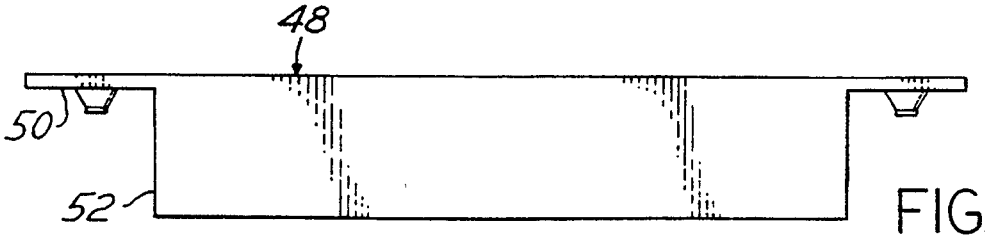

Another example of a molded elastomeric combined switch pad and reflector 48 is shown in FIGS. 6 and 7. The switch pad and reflector 48 includes a generally flat base sheet 50 and a forwardly extending rectangular protrusion 52. The front surface of the protrusion has three curved recesses 54, each recess 54 having a central opening 56 for receiving a lamp, not shown. The curved recesses 54 define reflector surfaces, which may be parabolic or other shape for efficient uniform light distribution to a display to be mounted in front of the protrusion 52. The frustoconical pushbutton switch elements 58 required for switching are located on the base sheet 50. Apertures 60 in the base sheet 50 accommodate lamps for illuminating a light pipe as in FIG. 2.

It will thus be seen that by forming a reflector surface in the elastomeric switch pad to assist in the illumination of a backlit display a separate reflector part is eliminated and the expense and complexity of the controller assembly is reduced.

The embodiments of the invention in which an exclusive property or privilege is claimed are defined as follows:

1. An electrical control having a backlit display and switch means adapted for manual operation, the electrical control comprising:

a panel;

a button associated with the panel;

a circuit board disposed adjacent the panel and having a pair of switch terminals;

an elastomeric switch pad disposed between the panel and the circuit board, the switch pad having a conductive pushbutton switch element aligned with the pair of switch terminals for selective closure against the switch terminals, the switch pad including an integrally-formed recess having a reflective surface facing the panel;

a light source mounted within the recess to illuminate the reflective surface thereof; and a display associated with the panel and mounted so as to be illuminated by the light source and light reflected by the reflective surface of the recess.

2. The electrical control as defined in claim 1 wherein the circuit board has an aperture aligned with the display;

the recess extends through the aperture to define a space between the reflective surface of the recess and the circuit board; and the light source is a lamp mounted in the space for illumination of the display.

3. The electrical control as defined in claim 1 wherein the switch pad comprises a plurality of concave reflective surfaces.

4. The electrical control as defined in claim 1 wherein the switch pad is formed of white material for reflecting the light from the light source to the display; and the conductive pushbutton switch element comprises a conductive pellet secured to the switch pad for bridging the pair of switch terminals.

* * * * *